United States Patent [19]

Bart et al.

[11] Patent Number: 4,534,341

[45] Date of Patent: Aug. 13, 1985

[54] GRAVITY LUMBAR REDUCTION MAINTENANCE APPARATUS

[75] Inventors: Gordon B. Bart, Sturgis; Carol L. Hiemstra, Spring Arbor; James H. Tyo, Jackson, all of Mich.

[73] Assignee: Camp International, Inc., Jackson, Mich.

[21] Appl. No.: 501,508

[22] Filed: Jun. 6, 1983

[51] Int. Cl.[3] ..... A61H 1/02

[52] U.S. Cl. ..... 128/75; 5/61; 5/63; 128/69; 128/71; 272/144

[58] Field of Search ..... 128/69, 70, 71, 73, 128/75, 134; 272/144; 269/322, 323, 324, 325, 326, 327, 328; 297/DIG. 10, 347; 5/63, 64, 65

[56] References Cited

U.S. PATENT DOCUMENTS

| | | | |
|---|---|---|---|
| 1,078,077 | 11/1913 | Arnold | 5/63 X |
| 2,904,039 | 9/1959 | Weissenberg | 128/69 |
| 3,948,513 | 4/1976 | Pfotenhauer | 272/144 |
| 4,129,916 | 12/1978 | Schlesinger et al. | 272/62 X |
| 4,194,500 | 3/1980 | Grimaldi | 128/75 |

FOREIGN PATENT DOCUMENTS

| | | | |
|---|---|---|---|
| 36127 | 3/1914 | Sweden | 269/322 |

*Primary Examiner*—Richard J. Apley
*Assistant Examiner*—Alan Cannon
*Attorney, Agent, or Firm*—Beaman & Beaman

[57] ABSTRACT

A gravity lumbar reduction maintenance apparatus of multiple use consisting of a rectangular frame capable of being mounted upon a tubular base in a variety of positions and orientations to the vertical. A web extending over the frame permits a patient to rest upon the web, and the frame may be oriented in a vertical manner having a harness affixed thereto providing support during therapy. The apparatus is characterized by its versatility and multiple modes of assembly permitting a wide variety of therapeutic treatment.

6 Claims, 7 Drawing Figures

GRAVITY LUMBAR REDUCTION MAINTENANCE APPARATUS

BACKGROUND OF THE INVENTION.

Medical apparatus used for gravity lumbar reduction treatment usually consists of a supporting member capable of limited adjustment and use, and special purpose apparatus, particularly medical apparatus which is relatively large and bulky in size, is difficult to store and handle, and requires considerable floor space. Conventional medical apparatus capable of functioning to support the patient in a horizontal, or semi-horizontal position, such as a table, is usually heavy and expensive, and such apparatus is not usually capable of being utilized for lumbar extension and traction purposes.

It is an object of the invention to provide versatile medial apparatus which may be used for gravity lumbar reduction maintenance therapy, and is capable of multimode use wherein the apparatus may be selectively employed for a number of purposes eliminating the need for more conventional single purpose devices.

A further object of the invention is to provide apparatus for supporting a patient's body in a variety of positions including traction and reclining positions, and where the apparatus is lightweight, readily handled and stored, and relatively inexpensive to manufacture.

An additional object of the invention is to provide patient supporting apparatus capable of functioning as a horizontal table, an obliquely related support, and a vertically disposed column for supporting hanger apparatus from which the patient may be suspended.

Yet another object of the invention is to provide medial apparatus which is of versatile character and assembly, inexpensively meets a variety of purposes of use with various types of medical treatment, and may be readily stored and transported.

An additional object of the invention is to provide gravity lumbar reduction maintenance apparatus including a patient supporting surface wherein the surface may be horizontally disposed permitting the apparatus to function as an examination table, and yet the supporting surface may be vertically oriented for traction purposes.

In the practice of the invention a tubular frame of a planar rectangular configuration includes a fabric web disposed thereover defining a patient supporting surface. The frame is mounted upon a tubular planar rectangular base, and a plurality of linkages and supports may be selectively used to interconnect the frame and the base in a variety of modes. Thus, the frame may be positioned parallel to the base, obliquely disposed thereto, or may be perpendicularly oriented to the plane of the base.

The linkages interposed between the base and frame include primary and secondary linkages, and one end of the frame may be directly connected to the base, if desired. Foot rests may be attached to the frame for the support of the patient, and a hanger may be selectively attached to the frame from which a patient supporting harness may be suspended for gravity traction purposes.

The components of the apparatus are primarily formed of tubing, and yoke and pin connections are utilized with the linkages to permit ease of assembly with a minimum of skill.

BRIEF DESCRIPTION OF THE DRAWINGS.

The aforementioned objects and advantages of the invention will be appreciated from the following description and accompanying drawings wherein.

Figure 1:
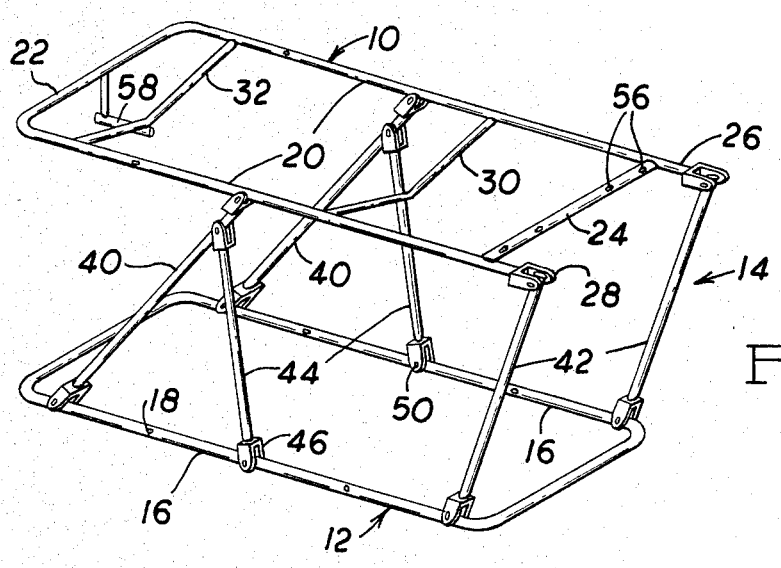
FIG. 1 is a perspective view of the apparatus of the invention, the frame being in a horizontal orientation, and the patient supporting web being removed for purpose of illustration.

DESCRIPTION OF THE PREFERRED EMBODIMENT.

The apparatus of the invention basically consists of a frame 10, a base 12, and linkages generally indicated at 14. These components are preferably formed of tubing, and may be bright plated, or formed of stainless steel, and the components may be readily fabricated by conventional welding or manufacturing techniques.

The base 12 is of a rectangular configuration and is formed of tubing which lies in a common plane. The base includes a pair of parallel spaced lateral sides 16 and holes 18 are formed in the sides within the plane of the base, the axis of the holes being perpendicular to the associated tubing.

The frame 10 is also of generally rectangular configuration and includes parallel sides 20, and upper end 22, and a lower cross piece 24. Holes 25 are defined in the sides 20 at selected locations. These components lie within a common plane. The sides 20 extend beyond the cross piece 24 at 26, and yoke fittings 28 are mounted upon the ends 26 of the sides. A bracing cross piece 30 extends between the sides, FIG. 1, and a cross piece 32 extends between the sides adjacent the end 22. The cross pieces 30 and 32 are deflected toward the base 12 from the plane of the frame as not to interfere with the patient supporting web 34, FIG. 3, which is stretched across the frame.

Figure 3:
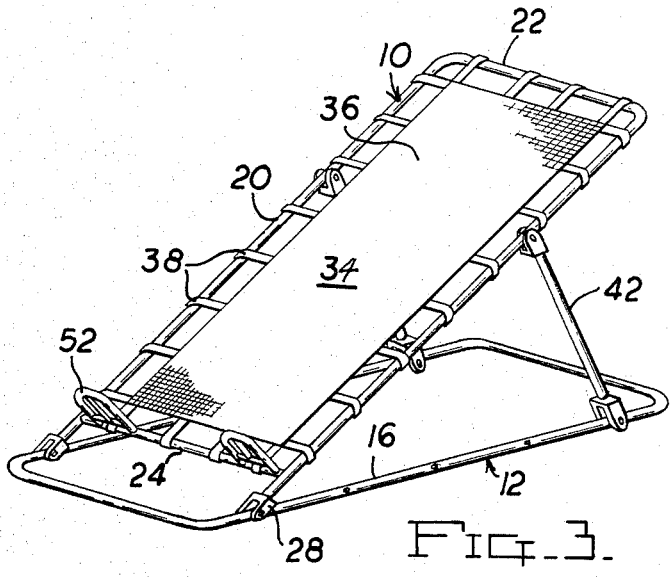
FIG. 3 is a perspective view of the apparatus wherein one end of the frame is directly attached to the base.

Web 34, in the preferred embodiment, consists of a woven or fabric portion 36 to which are attached a plurality of straps 38 wherein the web may be tensioned across the frame 10 by the straps, and the straps pass about the sides, end and cross piece as will be apparent from FIG. 3.

The apparatus includes a plurality of linkages 14, and the linkages will be selectively used depending upon the desired orientation of the frame to the base.

Usually, six linkages will be provided with each unit. These linkages are used in pairs, one pair being indicated at 40, a second pair being indicated at 42, and a third pair being indicated at 44, all being shown in FIG. 1. The sets are of different length, as will be apparent. Each of the linkages consists of a rigid tube having a yoke fitting 46 attached to at least one end. The yokes include parallel spaced portions 48 capable of straddling the sides of the base or frame, and holes extending through the yoke portions correspond in diameter to the holes located within the base sides 16 and the frame side 20.

Pins 50 are used to interconnect the yoke fittings to the base or frame, the pins being of a conventional type extending through the yoke portions 48 and frame or base holes upon the holes being aligned, and the pin includes a cotter key type lock to prevent the key from being inadvertently withdrawn once installed.

Figure 7:
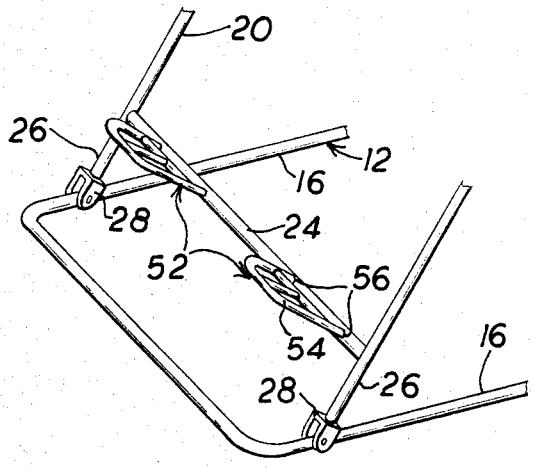
FIG. 7 is an enlarged detail perspective view of the lower end of the frame illustrating the foot rests.

Foot rests 52 may be attached to the frame cross member 24, and the foot rests consists of U-shaped members 54, FIG. 7, which are threaded at their ends for being received into holes 56 defined in the cross piece 24 having an axis perpendicular to the frame plane. The foot rests include cross piece within the U-configuration, and nuts, not shown, threaded upon the portions 54 extending through the cross piece 24 permit the foot rest to be firmly affixed to the cross piece in the manner apparent from the drawings.

Figure 5:
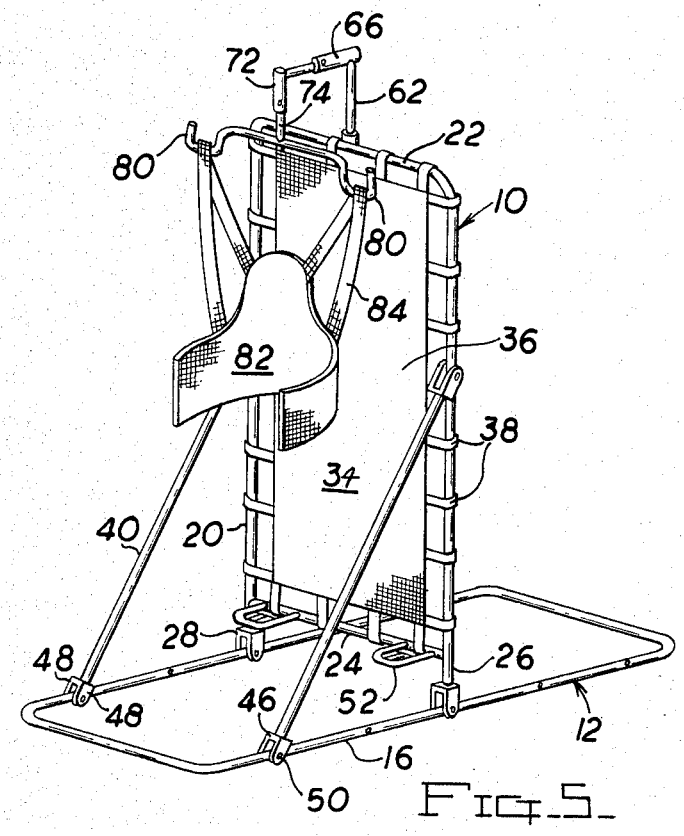
FIG. 5 is a perspective view illustrating the frame in a vertical orientation and the hanger apparatus and support belt in place.
Figure 6:
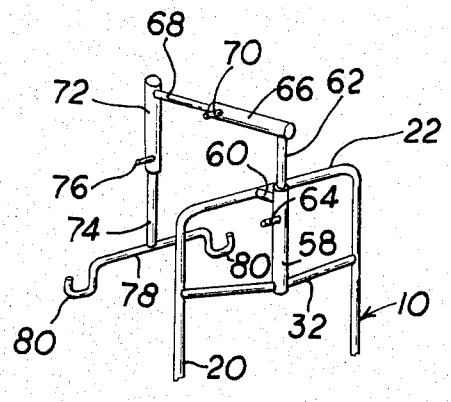
FIG. 6 is an enlarged, detail, perspective view of the frame hanger assembly.

The hanger apparatus for the frame is best illustrated in FIG. 5 and 6, and includes a sleeve 58 which is attached to the frame by the cross piece 32, and stub 60. A tube 62 is telescopingly received within sleeve 58, and is locked therein by transverse pin 64 extending through aligned holes in the sleeve and tube.

The tube 62, in turn, supports a sleeve 6 which receives tube 68 in telescoping manner and pin 70, and holes, permits adjustment of the tube in a direction at right angles to the plane of the frame 10.

The tube 68 supports sleeve 72 which telescopingly receives hanger column 74 connected to the sleeve by pin 76, and in each of the telescoping connections the holes defined in the sleeve and tube permit these components to be locked in the desired longitudinal relationship. A plurality of holes may be used to permit axial relative adjustment.

The hanger includes a cross piece 78 attached to the column 74 and hooks 80 are formed at the ends of the cross piece. In this manner a belt 82, FIG. 5, may be suspended from the hanger apparatus by means of straps 84. Thus, with the belt 82 encircling the patient's chest, and the belt suspended from the hanger as shown in FIG. 5, the patient's weight may be carried by the belt putting the spine under gravity tension forces to achieve the desired therapy.

When it is desired to support the frame in a horizontal manner the linkages 14 are arranged as shown in FIG. 1. Linkage sets 40 are interposed between the sides of the frame and base, linkages 42 are interposed between the side of the base and the frame end fittings 28, and secondary linkages 44 are interposed between the base 12 and the linkages 40, which are provided with a hole to permit the connection to the linkages 44. In this manner the frame is disposed in a horizontal orientation permitting the frame to serve as an examination table, stretcher, or similar purpose.

Figure 2:
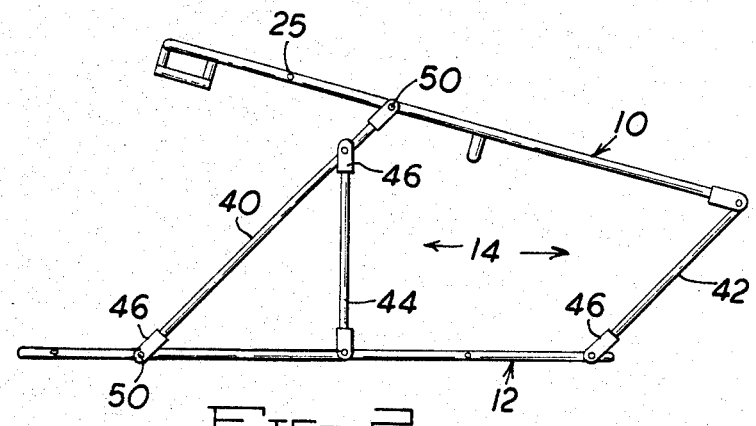
FIG. 2 is a side elevational view of the components as related to obliquely orient the frame.

The frame may be obliquely oriented as shown in FIG. 2 by changing the location of attachment of the lower fittings of linkages 40 on the base 12. If a greater angular orientation of the frame is desired the frame fittings 28 may be directly attached to the base 12 as shown in FIG. 3, and linkages interposed between the base and frame. The length of the linkages used, and the location of the base and frame holes used, will determine the angle of orientation between the base and frame, and whether or not the food rests 52 are attached to the frame cross piece is a matter of choice to the therapist.

Figure 4:
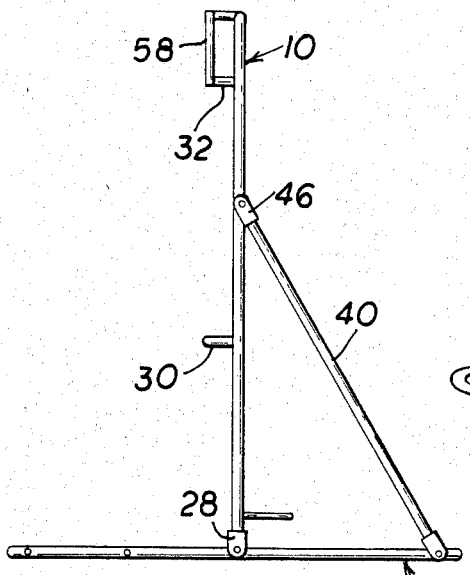
FIG. 4 is a side elevational view illustrating the frame in the vertical orientation.

When the hanger apparatus is to be used the frame 10 will often be in the vertical orientation of FIGS. 4 and 5, and linkages 40 will be employed in the disclosed manner. As is apparent, the linkages 40 are located well to each side of the belt 82 and will not interfere with the use of the belt during gravitational lumbar reduction treatment. It is also to be appreciated that the hanger and belt 82 may be used when the frame is obliquely oriented, as in FIG. 3, if a lesser degree of traction is desired.

From the aforedescribed description, it will be appreciated that the apparatus of the invention is highly versatile, and may be readily used by technicians as no unusual skills are required. The units may be readily used by technicians as no unusual skills are required. The units may be readily assembled for storage or shipping purposes, and the components are readily manufacturable by conventional fabrication techniques.

Modifications to the inventive concepts may be apparent to those skilled in the art without departing from the spirit and scope of the invention.

We claim:

1. Gravity lumbar reduction maintenance apparatus capable of being oriented to the vertical in a plurality of positions compsiring, in combination, a tubular base formed in a planar rectangular configuration having parallel sides and parallel ends, a tubular body frame formed in a planar rectangular configuration having parallel sides and parallel first and second ends, said body frame first end defined by an upper tubular cross piece and said body frame second end defined by a lower tubular cross piece, said body frame parallel sides each extending beyond said second end cross piece terminating in a free end, a yoke mounted upon each free end having spaced legs having aligned holes therein for receiving a pin, a plurality of first spaced connection means defined in said base sides, second connection means defined on said frame sides, a body supporting web affixed to said frame extending between said sides thereof, and at least a pair of primary links each having ends having connection means defined thereon associated with said base and said frame connection means to maintain a preselected angular relationship between said base and frame, the connection means on one end of a link cooperating with said first connection means on said base and the connection means on the other end of a link cooperating with said second connection means on said frame, said yokes being selectively connectable to said second connection means.

2. In a gravity lumbar reduction maintenance apparatus as in claim 1, foot rests defined on said frame lower cross piece.

3. In a gravity lumbar reduction maintenance apparatus as in claim 1, wherein said first and second connection means comprise spaced holes defined in said sides of said base and frame, respectively.

4. In a gravity lumbar reduction maintenance apparatus as in claim 1, a hanger socket defined upon said frame adjacent said first end thereof, a hanger adapted to be received within said socket, said hanger including patient weight bearing means.

5. In a gravity lumbar reduction maintenance apparatus as in claim 1, a pair of secondary links each having ends having connection means defined thereon, said primary links including secondary link connection means intermediate their ends whereby said secondary links may be connected at one end to said primary links intermediate said primary links' ends and at the other end to said base connection means.

6. In a gravity lumbar reduction maintenance apparatus as in claim 4, said hanger being connected to said upper cross piece and including a plurality of telescoping sleeve and tube connections, each sleeve and tube connection including holes adapted to be aligned, and a pin received within aligned holes, adjacent sleeve and tube connections being angularly related to each other permitting hanger adjustment transverse to the plane of said body frame.

* * * * *